United States Patent [19]

Weinberg

[11] Patent Number: 4,478,694

[45] Date of Patent: Oct. 23, 1984

[54] METHODS FOR THE ELECTROSYNTHESIS OF POLYOLS

[75] Inventor: Norman L. Weinberg, East Amherst, N.Y.

[73] Assignee: SKA Associates, Buffalo, N.Y.

[21] Appl. No.: 540,614

[22] Filed: Oct. 11, 1983

[51] Int. Cl.[3] ..... C25B 3/00

[52] U.S. Cl. ..... 204/77; 204/59 R

[58] Field of Search ..... 204/59 R, 77

[56] References Cited

U.S. PATENT DOCUMENTS

| | | | |
|---|---|---|---|
| 3,526,581 | 9/1970 | French | 204/77 |
| 3,899,401 | 8/1975 | Nohe et al. | 204/59 |
| 4,240,882 | 12/1980 | Ang | 204/77 |
| 4,270,992 | 6/1981 | Saito | 204/59 |
| 4,337,371 | 6/1982 | Kollar | 568/852 |

FOREIGN PATENT DOCUMENTS 3018844 12/1980 Fed. Rep. of Germany .

OTHER PUBLICATIONS

Tomilov, A. P. et al., *J. Obshchei Khimii*, vol. 43, (12) 2792 (1973).

Watanabe et al., *Toyo Soda Kenkyu Hokoku*, vol. 24, (2) 93–98 (1980).

Weinberg et al., *Abstracts of the Electrochemical Society*, Montreal Meeting, May, 1982.

*Primary Examiner*—John F. Niebling

*Attorney, Agent, or Firm*—Michael L. Dunn; Howard M. Ellis

[57] ABSTRACT

The electrosynthesis of ethylene glycol conducted with a formaldehyde-containing electrolyte provides unexpectedly higher current efficiencies at pH's maintained above about 5 to below about 7. Performance may be improved further through use of electrolytes having high formaldehyde-low methanol concentrations and with oxygen-containing organic compounds. Cell components such as gas diffusion electrodes and oxidized carbon or graphite cathodes also enhance current efficiencies.

35 Claims, 1 Drawing Figure

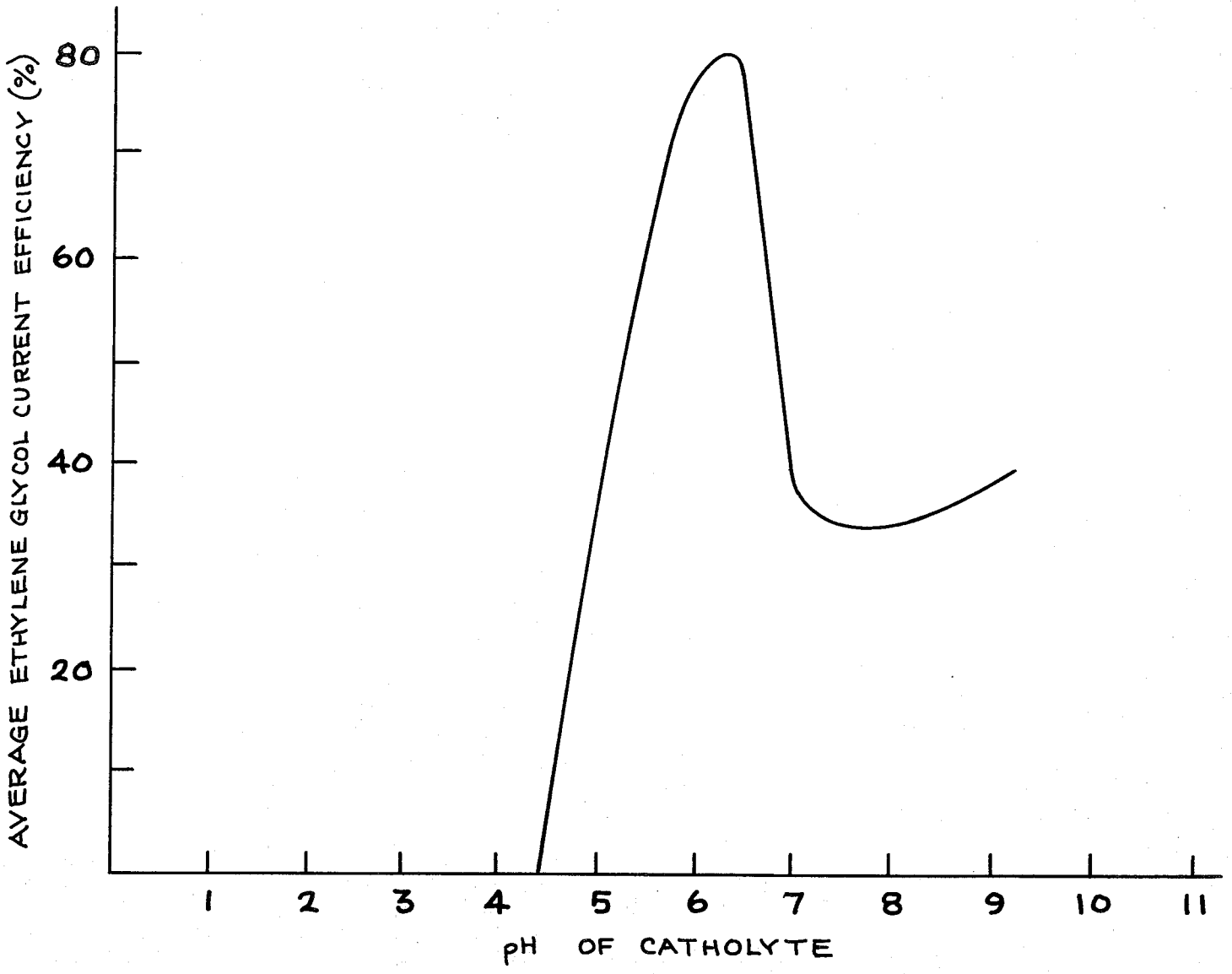
AVERAGE ETHYLENE GLYCOL CURRENT EFFICIENCY (%)
80
60
40
20
1
2
3
4
5
6
7
8
9
10
11
pH OF CATHOLYTE

METHODS FOR THE ELECTROSYNTHESIS OF POLYOLS

BACKGROUND OF THE INVENTION

The present invention relates to the electrochemical synthesis of polyols, and more particularly, to improved methods for the electrochemical conversion of formaldehyde-containing electrolytes to alkylene glycols, such as ethylene glycol, propylene glycol, and the like.

Polyols, and in particular alkylene glycols are major industrial chemicals. The annual production rate of ethylene glycol, for example, in the United States alone is about 4 billion pounds per year. Ethylene glycol is widely used as an automotive coolant and antifreeze. It also finds major applications in manufacturing processes, such as in the production of polyester fibers. In addition to such major uses as heat transfer agents and fiber manufacturing, alkylene glycols also find use in the production of alkyd resins and in solvent systems for paints, varnishes and stains, to name but a few.

The major source of ethylene glycol is derived from the direct oxidation of ethylene from petroleum followed by hydration to form the glycol. However, dwindling petroleum reserves and petroleum feedstocks coupled with escalating prices has led to the development of alternative routes for making polyols. For example, processes based on catalytic conversion of synthesis gas at high pressure appear to offer promise. The reaction for making ethylene glycol by this route may be shown as:

$$2\,CO + 3H_2 \rightarrow HOCH_2{-}CH_2OH$$

Representative processes are described in U.S. Pat. Nos. 3,952,039 and 3,957,857.

Other attempts to produce ethylene glycol and higher polyols from non-petroleum feedstocks have involved the electrochemical route. Heretofore, electrochemical methods of organics manufacture have not been widely accepted mainly because they were generally viewed as being economically unattractive.

Tomilov and coworkers were apparently the first to reduce formaldehyde electrochemically in aqueous solution to ethylene glycol. This work was published in *J. Obschei Khimii,* 43, No. 12, 2792 (1973); *Chemical Abstracts* 80, 77520d (1974). Further work by Watanabe and Saito, *Toyo Soda Kenkyu Hokoku,* 24, 98 (1979); *Chemical Abstracts,* 93, 227381u (1980), aspects of which are described in U.S. Pat. No. 4,270,992 disclose the reduction of formaldehyde under alkaline conditions forming ethylene glycol at maximum current efficiences of up to 83%, along with small amounts of propylene glycol. However, most conversion efficiencies reported by Watanabe et al supra were not at such high levels although conducted under alkaline conditions.

More specifically, U.S. Pat. No. 4,270,992 discloses a method for making ethylene glycol or propylene glycol through electrochemical coupling of formaldehyde solution employing an electrochemical cell equipped with graphite electrodes. The U.S. patent provides that ethylene glycol is not formed under acid conditions, but instead a pH of more than 8 is required. Watanabe et al supra even tested various supporting electrolytes, including tetraethylammonium tosylate in a formaldehyde electrolyte under acid conditions without controlling the pH which resulted in low current efficiencies (26%).

U.S. Pat. No. 3,899,401 (Nohe et al) relates to the electrochemical production of pinacols like tetramethylene glycol from carbonyl compounds, such as acetone which may be converted into pinacolone or 2,3-dimethylbutadiene. Nohe et al do not teach the electrosynthesis of either ethylene or propylene glycol, but do mention one aldehyde, namely acetaldehyde which may be electrochemically reduced in an undivided cell. Like Watanabe et al supra, Nohe et al also mention quaternary ammonium salts. However, Nohe et al also require that such electrochemical reactions be conducted by the addition of up to 90 percent by weight alcohol, (for example, ethanol in the case of acetaldehyde reduction) to the electrolyte. By comparison, Weinberg and Chum, Abstracts of the Electrochemical Society Meeting, Abstracts No. 589, pages 948–949, May, 1982 reported that the presence of alcohol (methanol) in the electrolyte depresses the conversion efficiency of formaldehyde to ethylene glycol, and that the best conversion efficiencies were achieved with the lowest level of alcohol in the electrolyte.

The early studies by Tomilov et al supra related to the electrochemical reduction of formaldehyde under acid conditions i.e. pH from 2 to 5 using a graphite electrode in a medium of potassium dihydrogen phosphate solution and mercury (II) catalyst to form ethylene glycol at a current efficiency of 24.9%. The yields of glycols calculated on the aldehydes taken were 46.2 and 70.7%.

Accordingly, there is a need for a more reliable and efficient alternative for making alkylene glycols from non-petroleum feedstocks, and more particularly, there is a need for an improved electrochemical means for making ethylene glycol by the reduction of formaldehyde. By necessity, the electrochemical route should offer a high degree of product selectivity providing reproduceable results with more consistent, higher yields and current efficiencies to minimize electrical energy requirements. Correspondingly, such glycols should be formed at high concentrations for lower separation costs. Most optimally, the electrochemical condensation of formaldehyde in making ethylene glycol should provide for useful anode reactions utilizing electrolyte additives and cell components e.g. electrodes which will perform as electrocatalysts for optimum conversion of organic molecules to the desired end product.

The present invention provides such improved methods and apparatus for the electrosynthesis of lower alkylene glycols from non-petroleum based feedstocks, namely coal and biomass. More particularly, the invention disclosed herein relates mainly to the preparation of ethylene glycol, and other lower polyols with reduced levels of by-products through the electrochemical reduction of formaldehyde under conditions which make such routes economically feasible, and therefore, competitive with alternative chemical routes. The electrochemical reduction of formaldehyde can now be carried out at high current efficiencies by controlling both reaction conditions and electrolyte composition. The present invention also relates to improved electrochemical cell components which enhance the efficient conversion of formaldehyde to ethylene glycol and hence make the economics more attractive.

SUMMARY OF THE INVENTION

In accordance with the invention there is provided an electrochemical reaction in which alkylene glycols, such as ethylene glycol and other lower polyols are formed at both high concentrations and current efficiencies by the reduction of formaldehyde-containing electrolytes, said reaction being carried out in an electrolyzer equipped with a metal, carbon or graphite anode and graphite or carbon cathode.

The electrochemical reaction is preferably conducted with a catholyte having a pH which is somewhat acidic ranging from about 5 or slightly above to about 7 or less. It was found that by maintaining the reaction under slightly acidic conditions there is less tendency for competitive chemical reactions taking place, like the formation of polymers e.g. paraformaldehyde and formose sugars, including base-catalyzed Canizzaro side reactions leading to the formation of methanol and formates. Such by-products not only result in the loss of formaldehyde, but also create product separation difficulties. The build-up of methanol at the cathode or the presence of methanol in the electrolyte adversely affects the efficiency at which alkylene glycols are formed. Thus, one aspect of the present invention relates to an unexpected improvement in conversion efficiencies achieved in the electrochemical reduction of formaldehyde-containing electrolytes by operating within a relatively narrow pH range controlled and maintained above 5 and below 7.

Similarly, another aspect of the present invention is the electrochemical reduction of formaldehyde-containing electrolytes at improved current efficiencies by means of chemical additives. For example, the use of electrolyte additives, such as certain quaternary salts, quite surprisingly were found to reduce hydrogen evolution side reactions even at low pH's e.g. 3.5 while enhancing the current efficiency of ethylene glycol formation to at least 50 percent and higher. Thus, use of various electrolyte additives provide for a wide flexible range of operating conditions while enhancing conversion efficiencies of the reaction.

In order to form electrolysates which are more economic in terms of separation costs, while minimizing any adverse affect on current efficiency, the present invention also contemplates the use of improved formaldehyde-containing electrolytes. In this regard, it has been discovered that high conversion efficiencies are not restricted to dilute (about 10%) solutions of ethylene glycol, but instead, the concentrations of such electrolysates can be significantly increased through electrolytes having higher free-formaldehyde availability and minimal methanol concentration i.e. . . . without methanol being added to the electrolyte. Ordinary stock solutions of formalin, for example, containing 37% formaldehyde can have only minor amounts of free formaldehyde available because methanol forms a strongly bound hemiacetal with the formaldehyde. Therefore, a further aspect of the present invention relates to the discovery that more concentrated ethylene glycol electrolysates can be prepared without penalty in current efficiency through reduction of electrolytes which are free of added alcohol and have higher concentrations of free/unbound formaldehyde.

A further aspect of the present invention relates to the finding that more efficient electrochemical reduction of formaldehyde takes place with surface oxidized carbon cathodes which includes both graphite and amorphous carbon types. More specifically, it was discovered that the introduction of oxygenated functional groups onto the surfaces of graphite and carbon cathodes by chemical or electrochemical means can improve performance in many instances. Although it cannot be stated with absolute certainty, the mechanism for the improved performance is believed to involve such surface "oxides" via a complexation reaction with formaldehyde. That is, dimerization of the aldehyde appears to be aided by carbon or graphite-hemiacetal surface groups which are then electrochemically reduced to alkylene glycols.

In addition to surface oxidized carbon cathodes the present invention also contemplates conducting the electrosynthesis at high current densities and low cell voltages to maximize product output while minimizing capital costs and power consumption. Current densities may be increased, for example, by increasing the surface area of the carbon cathode. High surface area carbon cathodes, such as porous flow through cathodes having porosities of at least 20 percent, packed carbon beds and even fluidized carbon beds can support higher current densities.

Correspondingly, cell voltages may be lowered by various mechanisms, such as through elimination of cell membranes or separators from between electrodes and/or moving the electrodes closer together. In addition, by operating the cell at elevated temperatures one may efficiently lower the cell voltage and increase current efficiencies of glycol formation.

DESCRIPTION OF THE PREFERRED EMBODIMENT

This invention relates to methods and devices for the electrochemical reduction of formaldehyde to form polyols where the formaldehyde is derived from a number of sources including methanol produced from biomass or coal.

The methods and devices for the electrosynthesis of polyols are primarily concerned with preparation of ethylene glycol. The term "polyols" also includes in a secondary capacity the preparation of related compounds like propylene glycol and glycerol.

The electrochemical conversion of formaldehyde to ethylene glycol can be significantly enhanced through the use of improved electrolytic cell components, operating conditions, electrolytes and various combinations thereof. One principal objective herein is to provide inter-alia improved electrodes; operating conditions favoring higher ethylene glycol current efficiencies; reduced power consumption through lower cell voltages and higher current densities for maximizing product output with favorable economics.

The electrosynthesis of polyols according to the present invention is carried out in an electrolytic cell equipped with electrodes consisting of carbon or metal anodes and carbon cathodes. The anodes may be comprised of various forms of carbon including graphite, as well as electrically conductive amorphous carbons such as those prepared from charcoal, acetylene black, and lamp black, as well as metals like iron, nickel, lead, various alloys which include noble metals, like platinum and ruthenium or those generally known as dimensionally stable anodes comprising, for example, mixtures of noble and non-noble metal oxides e.g. . . . ruthenium oxide deposited over valve metals, like titanium or other appropriate conductive metal substrates.

Ordinarily, the major reactions at the anode in an unseparated cell operation involve the oxidation of the formaldehyde electrolyte and in a separated cell configuration, the evolution of oxygen. However, the process of the subject invention contemplates a useful anode reaction where, for instance, methanol is fed to the anode compartment of a cell equipped with a separator or membrane and oxidized to formaldehyde. Under such circumstances, the formaldehyde formed may be used to replenish the formaldehyde-containing catholyte.

Other economically viable processes may be conducted at the anode which may eliminate the need for membranes, diaphragms or other forms of compartmental separators which collectively will be advantageous in lowering cell voltages and incrementally reduce overall power consumption in the electrosynthesis of glycols at the cathode. In this regard, the present invention also includes the application of gas diffusion electrodes as anodes in conducting a "useful anode process" which is intended to mean any reaction occuring at the anode which will lower power consumption and/or form in-situ a product or equivalent which can be utilized in the process described herein.

Gas diffusion electrodes, such as the kind commonly used in fuel cells are generally comprised of a conductive material e.g. graphite or carbon, or a conductive oxide, carbide, silicide, etc., a resin binder which may be a fluorinated hydrocarbon such as polytetrafluoroethylene and a metal, like platinum or other materials suitable for catalyzing the conversion of hydrogen to protons, carbon monoxide to carbon dioxide, and methanol at the anode to formaldehyde. One example of a commercially available gas diffusion electrode is the Prototech electrode PWB-3 available from the Prototech Company, Inc. Newton Highlands, Mass. This Company also manufactures a wide range of such electrodes for use under various pH and other conditions.

The cathodic material for the reduction of formaldehyde to polyols is generally limited to "carbons", which for purposes of this invention is intended to mean graphite and conductive amorphous carbons in the form of sheets, rods, cloth, fibers, particulates, as well as polymer composites of the same. Quite surprisingly, it was found that carbons are unique in their ability to support the formation of polyols electrochemically; whereas, even carbides, including carbon steel and other commonly used cathodic materials like zinc, lead, tin, mercury, amalgams, aluminum, copper, etc., are generally ineffective in catalyzing the reduction of formaldehyde and formation of polyols. The precise explanation for this rather unusual requirement remains unclear. However, the limitation on the cathode material appears to involve oxides on the surfaces of carbon cathodes. The unique behavior, for example, of graphite as a preferred cathodic material may be explained mechanistically as possibly resulting from the presence of a carbon "oxide" surface which suggests binding aldehyde in hemiacetal form and in a fixed geometry appropriate to glycol formation. That is, certain oxide species, possibly acidic phenolic hydroxide groups, on the surface of graphite react with the formaldehyde to form vicinal intermediate hemiacetals which undergo an intramolecular dimerization to form ethylene glycol. Accordingly, one explanation for the electrochemical reaction is believed to be a hydrodimerization process taking place on the carbon oxide surface via formation with formaldehyde of carbon hemiacetal surface groups which are subsequently reduced to form the polyols.

Based on the above supposition linking the reduction of formaldehyde to the presence of carbon-oxygen reaction sites on cathodes, it was discovered that preoxidation of cathodes can provide improved current efficiencies in the electrochemical preparation of alkylene glycols. For example, cathode performance of oxidized graphite which normally would possess little carbon-oxygen surface functionality can be improved substantially in current efficiency over unoxidized graphite.

Surprisingly, the preoxidation of carbons can provide improved performance when treated chemically by exposure, for instance, to a range of chemical oxidizing agents such as nitric acid, sodium hypochlorite, ammonium persulfate, or alternatively to a hot stream of gas containing oxygen. These methods are described by Boehm et al in *Angew. Chem, Internat. Ed.*, 3, 699 (1964). In some cases, it is more convenient that the preoxidation of carbons be performed electrochemically by operating the cathode as an anode in an aqueous acid or alkaline electrolyte which forms substantial carbon oxide functionality on the cathode surface. Electrochemical preoxidation is usually conducted to the extent of passage of 1 to 5000 coulombs/cm$^2$, and more in the case of high surface area carbons.

In addition to the foregoing surface oxide characteristics of the carbon cathodes, the electrochemical reaction should be conducted at high current densities e.g. 100 to 500 mA/cm$^2$ and higher to maximize product output. This is best achieved by means of porous, high surface area cathodes having, for example, flow through properties ranging from about 20 to about 80 percent porosity. Alternatives would include cathodes in the form of packed graphite or carbon beds wherein the graphite or carbon particles are in good electrical contact with one another. An example of such a packed bed cell is the Enviro-cell ® offered by Deutsche Carbone Aktiengesellschaft, suitably modified for the present purpose. Another embodiment of a high porosity type carbon cathode would be a fluidized bed type.

Gas diffusion electrodes as described above for use as anodes, may also be used as cathodes, providing the composite structure contains carbon or graphite. A gas diffusion cathode would utilize gaseous anhydrous or wet formaldehyde as the feedstock.

In maintaining a desirable rate of power consumption through low cell voltages i.e. 4.5 volts or less, the present invention contemplates reducing cell I.R. drop by various means, including minimizing the interelectrode gap or separation between individual anodes and cathodes, use of so-called zero gap electrode-separator elements, and/or operation of the cell without compartmental separators. However, it may be operationally desirable, for example, to minimize oxidation of ethylene glycol at the anode by means of a cell membrane or diaphragm type separator. Any of the widely known electrolytic cell separators can be used, including anionic as well as cationic types, such as sulfonated polystyrene and the perflurorosulfonic acid type membranes available from E. I. DuPont de Nemours Company under the Nafion trademark. Other examples would include porous polypropylene and polyfluorocarbon separators, like Teflon ® type microporous separators, etc.

The electrolyte composition, or catholyte when a cell separator or membrane is employed, is comprised of the concentration aqueous formaldehyde solutions. Electrolytes as low as 5 to 10 weight percent formaldehyde may be employed, but the formaldehyde concentration should preferably be greater than 10 percent because ethylene glycol current efficiencies tend to drop off with possible increase in undesired hydrogen evolution and methanol formation. In addition, low concentrations of formaldehyde result in dilute solutions of alkylene glycols having high concentrations of water which translates into higher separation costs. Thus, electrolytes/catholytes containing up to 70 weight percent formaldehyde and higher are most preferred for higher conversion efficiencies and more economic separation.

Optimally, the electrolyte will be free or substantially free of methanol i.e. . . . less than 5 percent, and more preferably, less than 2 percent, to maximize current efficiency and increase the availability of free formaldehyde in solution. Accordingly, the electrolytes/catholytes preferably contain from about 20 to about 70% by weight formaldehyde free or substantially free of methanol. Representative sources of formaldehyde include formalin solutions containing about 37% or more formaldehyde. One example is a 52% formaldehyde solution known as LM 52 available from DuPont wherein the LM designation refers to a low methanol content of generally less than 2% and usually about 1%. However, formalin solutions typically contain about 10% methanol added to inhibit polymerization of the formaldehyde, and consequently, have only minor amounts of available free formaldehyde. Such solutions may be used, but preferred alternatives include high concentration solutions containing up to 70 weight percent formaldehyde or more. Formaldehyde solutions made in-situ, such as from solid formaldehyde polymers like paraformaldehyde added to the catholyte. Gaseous formaldehyde fed to the electrolyte/catholyte is another alternative source of catholyte feed. Residual formaldehyde recovered during the separation phase of the process can also be recycled back to the cell for further electrosynthesis. In each instance the objective is to utilize those electrolytes having the highest concentration of formaldehyde and lowest level of methanol or are least likely to form methanol during the process.

Ethylene glycol current efficiencies are highly dependent upon pH. By controlling and maintaining the pH of the electrolyte on the acid side between above 5 and below 7, undesirable chemical side reactions leading, for example, to methanol and formic acid or polymers such as formose sugars are minimized. At this pH range ethylene glycol efficiencies are enhanced to at least 50 percent and more i.e. . . 65 to 90 percent and higher. Preferably, the pH will range from more than 5 to less than 7, and more specifically, from about 5.5 to about 6.5. By contrast, it was found that little or no ethylene glycol is formed at pH's below about 5 e.g. 4.5, and current efficiencies tail off at pH's greater than 7. Thus, quite surprisingly, it was found that optimum performance is achieved by conducting the electrosynthesis within this relatively narrow pH range.

In addition to the controlled acid pH range as a means for improving the overall current efficiency in the electrosynthesis of ethylene glycol it was observed that formaldehyde conversion efficiencies may also be improved through the use of efficiency enhancers which are electrolyte additives comprising various oxygenated compounds, usually organic compounds, possessing oxygen functionality such as that known to exist on the surface of oxidized carbons. For example, N. L. Weinberg and T. R. Reddy in the *Journal of Applied Electrochemistry*, 3,73 (1973) describe this functionality as consisting of carbonyl, hydroxyl, lactone, and carboxylic acid groups. As such these oxygenated efficiency enhancers may, for example, possess quinone, hydroquinone, unsaturated α-hydroxyketone and α-diketone structures. Examples of such compounds include chloranilic acid, alizarin, rhodizonic acid, pyrogallic acid and squaric acid. Also of particular interest are those oxygenated compounds which form relatively stable redox couples in solution such as oxygenated photographic developing agents. Grant Haist, in *Modern Photographic Processing*, Vol. 1, John Wiley & Sons, 1979 describes a variety of oxygenated developing agents including ascorbic acid and phenidone.

The above current efficiency enhancers have a tendency to reduce the hydrogen evolution side reaction and catalyze glycol formation. One possible explanation for the improved performance experienced with the foregoing additives is that these molecules possibly mimic the graphite or carbon oxide surfaces of the cathode sufficiently to behave as soluble or adsorbed electrocatalysts in the reduction process. The enhancers are added to the formaldehyde-containing electrolyte in an amount sufficient to elevate the current efficiency. More specifically, the efficiency enhancers are added to the electrolyte in an amount from 0.1 to about 5 weight percent, and more optimally from about 0.1 to about 2 weight percent.

As previously disclosed, the most advantageous conditions for the electrochemical reduction of formaldehyde-containing electrolytes is by controlling their pH between 5 and 7, and that performance in terms of conversion efficiencies can be enhanced through the addition of oxygenated oraganics or salt thereof. Accordingly, as a further embodiment of the present invention it was found that the optimum peak in current efficiency as it relates to pH, such as illustrated in the accompanying drawing which will be described in greater detail below, may be significantly broadened by the addition of quaternary salts to the electrolyte. That is to say, it was discovered that the electrosynthesis of ethylene glycol may be carried out generally under acid, neutral or alkaline conditions in the presence of quaternary salts added to the formaldehyde-containing electrolyte.

Useful quaternary salts include those which when added the electrolyte are capable of enhancing the ethylene glycol current efficiency to at least 50 percent, and more preferably, 65 to 90 percent or higher and includes salts selected from the group consisting of ammonium, phosphonium, sulfonium salts and mixtures thereof. More specifically, the electrochemical reduction of formaldehyde may be conducted at conversion efficiencies of not less than 50 percent and at an electrolyte pH ranging from as low as 1.0 to about 10.0 or even greater, and more specifically, from about 3.0 to about 8.0 by the addition of various quaternary salts. Specific embodiments of quaternary ammonium salts are tetramethylammonium methylsulfate, tetramethylammonium chloride, tetraethylammonium p-toluenesulfonate, tetraethylammonium formate, tetra-n-butylammonium acetate, benzyltrimethylammonium tetrafluoroborate, bis-tetramethylammonium sulfate, bis-tetraethylammonium phosphate, trimethylethylammonium ethylsulfate, ethyltripropylammonium proprionate, bis-dibutylethylhexamethylenediammonium sulfate, bis-N,N-dimethylpyrrolidinium oxalate, cetylrimethylammonium bromide, and the like.

Suitable quaternary phosphonium salts include, for example, tetramethylphosphonium iodide, benzyltriphenylphosphonium chloride, ethyltriphenylphosphonium acetate, tetrabutylphosphonium formate, bistributyltetramethylenephosphonium bromide, (2-hydroxyethyl)triphenylphosphonium formate, etc. Representative quaternary sulfonium salts include triethylsulfonium hexafluorophosphate, triethylsulfonium hydrogensulfate, tributylsulfonium tetrafluoroborate.

The foregoing quaternary salts are employed in amounts sufficient to maintain a constant current efficiency of not less than 50 percent, and more specifically, in amounts from about 0.01 to about 5 weight percent. More optimally, the quarternary salts are utilized at about 0.1 to about 2 weight percent.

In carrying out the electrosynthesis of polyols according to the present invention, and particularly in those instances where current conducting electrolyte additives are omitted current conducting salts are utilized in the electrolyte. Preferred examples include both organic and inorganic salts like sodium formate, sodium acetate, sodium sulfate, sodium hydrogen phosphate, potassium oxalate, potassium chloride, potassium hydrogen sulfate, sodium methylsulfate, etc., added in a sufficient amount to provide a suitable conducting solution, ranging from about 1 to 10 weight percent.

The electrosynthesis of lower alkylene glycols is most favorably conducted at elevated temperatures, generally ranging from about 30° to about 85° C., and more perferably, from about 45° to about 75° C. In this connection, it was found that higher cell temperatures also provide lower cell voltages and hence lower power-consumption. The improved current efficiency may be attributed to increased levels of free-formaldehyde in the electrolyte.

The electrochemical formation of alkylene glycols according to the present invention may be carried out utilizing any cell design considered acceptable for organic electrosynthesis. For example, a simple flow cell of the plate-and-frame or filter press type may be used consisting of electrodes, plastic frames, membranes and seals bolted tightly together to minimize leakage. Such cells may be either monopolar or bipolar in design. Several monopolar type cells suitable for the electrosynthesis of alkylene glycols are available from Swedish National Development Company under the MP and SU trademarks. The capacities of such cells can be incrementally increased by adding extra electrodes and membranes to the cell stack. The process according to the invention may be conducted either as a batch or continuous operation.

The following specific examples demonstrate the various aspects of the present invention, however, it is to be understood that these examples are for illustrative purposes only and do not purport to be wholly definitive as to conditions and scope.

EXAMPLE I

A laboratory scale electrolytic system for electrosynthesis of ethylene glycol was set-up.

A monopolar electrochemical membrane cell manufactured by Swedish National Development Company, Stockholm and available under the trademark MP was fitted with two Union Carbide Company ATJ graphite cathodes and one titanium anode having a outer platinum coating. The total available cathode electrode surface area was 0.02 $m^2$. A cationic permselective membrane available from E. I. DuPont under the Nafion 390 trademark was installed into the electrochemical cell separating the anode and cathode compartments. The interelectrode gap in this cell was 12 mm. One or both graphite cathodes were placed into the circuit as needed by parallel connection of the negative terminals. A model DCR 60-45 B Sorensen DC power supply was used to provide constant current to the cell. In order to make voltage measurements a digital multimeter was installed. A digital coulometer Model 640 available from The Electrosynthesis Company, Inc., E. Amherst, N.Y. and a pH meter were also employed to monitor and control the extent of the reaction and pH of the catholyte.

A catholyte was prepared consisting of two liters of formalin (ACS, Eastman Kodak) containing 3M sodium formate as a current carrier. The pH of this solution was constantly maintained at 4.4 by the addition of small amounts of formic acid. The anolyte was comprised of two liters of 18% sulfuric acid in water. The electrolyte solutions were circulated to the cell and returned to reservoirs continuously by means of March (Model TE-MDX-MT3) explosion proof magnetic pumps. A glass condenser in the anolyte loop served as a heat exchanger, assisting in maintaining a catholyte temperature of 57° C. The catholyte reservoir was provided with fittings for recirculating catholyte, vent, thermometer, gas (hydrogen) sampling, liquid sampling and pH adjustments. The anolyte reservoir was provided with fittings for recirculating the anolyte via a glass heat exchanger, vent, thermometer and gas outlet. Two saturated calomel reference electrodes (SCE) were inserted into the electrolyte inlets to the cell to monitor the cell voltage, electrode potential and IR drops. The catholyte flow rate was 1.0 l/min.

After the catholyte temperature had reached 57° C., electrolysis was commenced at a constant catholyte current density of 100 mA/$cm^2$. The cell voltage averaged 5.4 volts and the cathode potential was −2.8 Vvs SCE. Hydrogen gas was collected during the course of the electrolysis. After passage of 4.4 Faradays of charge the catholyte solution was analyzed for ethylene glycol and propylene glycol by means of gas chromatography using a Poropak Q column at 175° C. Product analysis showed no trace of ethylene or propylene glycols after 4.4 Faradays. The hydrogen gas current efficiency was 83%.

EXAMPLE II

Following the same procedure as in Example I a second run was performed except the pH of the catholyte was elevated and maintained at 5.4 by adjusting with formic acid and sodium hydroxide. After the passage of 4.3 Faradays product analysis showed ethylene glycol formed at a current efficiency of 52% with trace amounts of propylene glycol. The hydrogen current efficiency was 15 percent.

EXAMPLE III

The procedures of Example I are repeated except the pH is adjusted to 5.8 providing an ethylene glycol current efficiency after passage of 5.0 Faradays of charge of about 70% with trace amounts of propylene glycol and a 10% hydrogen current efficiency.

EXAMPLE IV

The same procedure was used as in Example I except 100 ml of 20% aqueous solution of tetraethylammonium hydroxide was added to the catholyte and the pH of the catholyte adjusted and maintained at 6.5. The cell voltage during electrolysis was 5.7 and the cathode potential averaged −3.1 Vvs SCE. Average product current efficiencies after 5.7 Faradays of charge were: ethylene glycol 78%, propylene glycol 2% and hydrogen 3%. The highest ethylene glycol current efficiency measured during this run was 86%. The current efficiency was improved by almost 23% over the reaction conducted without quaternary salt added.

EXAMPLE V

Following the procedure of Example I the pH of the catholyte was adjusted and maintained at 7.0. No electrolyte additives were employed. Current efficiencies after 5.3 Faradays of charge passed were 36% ethylene glycol; trace of propylene glycol and 24% hydrogen current efficiency.

Table 1 provides a summary of Examples I–V.

TABLE 1

| Example | Current Density (mA/cm²) | Cathode Potential (−Vvs SCE) | Temp. (°C.) | *Catholyte Additives | Faradays Passed | Cell Voltage | Catholyte pH | Average Current Efficiency (%) EG | PG | $H_2$ |
|---|---|---|---|---|---|---|---|---|---|---|
| 1 | 100 | 2.8 | 57 | NIL | 4.4 | 5.4 | 4.4 | NIL | NIL | 83 |
| 2 | 100 | 2.5 | 58 | NIL | 4.3 | 5.4 | 4.4 | 52 | TRACE | 15 |
| 3 | 100 | 2.5 | 58 | NIL | 5.0 | 5.4 | 5.8 | 70 | TRACE | 10 |
| 4 | 100 | 3.1 | 58 | **TEAH | 5.7 | 5.7 | 6.5 | 78 | 2 | 3 |
| 5 | 100 | 3.2 | 58 | NIL | 5.3 | 5.8 | 7.0 | 36 | TRACE | 24 |

*Catholytes included 3M sodium formate in 2 liters formalin
**100 ml −20% aqueous tetraethylammonium hydroxide (Aldrich Chemical Co.)

The accompanying drawing comprises a plot of Examples I–V and demonstrates ethylene glycol current efficiencies are dependent on maintaining a constant pH of greater than 5 but less than 7.

EXAMPLE VI

In order to demonstrate the effect of quaternary salts on the electrosynthesis of ethylene glycol a laboratory electrochemical cell comprising a glass vessed having a volume of about 150 ml served as the electrolysis cell. The cell was fitted with a platinum anode, graphite rod (UltraCarbon ST-50) cathode, saturated calomel reference electrode (SCE) placed near the cathode, and a magnet for magnetically stirring the solution. The cell was operated without a separator for anolyte and catholyte, and was maintained at an operating temperature of 55° C. by means of an external water bath.

The electrolyte consisted of 100 ml of formalin (ACS Eastman Kodak) which had dissolved 1.0 molar of supporting electrolyte. The electrolysis was conducted by means of a potentiostat (Electrosynthesis Company, Inc. Model 410) at a controlled cathode potential of about −2 volts measured against the SCE reference electrode. The cathode current density was about 70 mA/cm².

Table 2 shows the role of pH and the benefit of quaternary salts in extending the useful pH range.

TABLE 2

| Experiment | Electrolyte Additives | Coulombs Passed | Ethylene Glycol Current Efficiency (%) |
|---|---|---|---|
| 1 | 1.0 M ammonium formate pH = 3.6 to 4.5 | 14,000 | Nil |
| 2 | 1.0 M ammonium formate pH= 6.3 to 7.5 | 14,000 | 17 |
| 3 | 1.0 M sodium formate + $HCO_2H$ pH = 3.9 to 4.5 | 16,050 | Nil |
| 4 | 1.0 M $(CH_3)_4NCl$ pH = 3.3 to 3.5 | 15,000 | 76 |
| 5 | lg of $(C_2H_5)_4NClO_4$ plus 1.0 M sodium formate pH = 8.0 | 15,000 | 85 |
| 6 | lg of benzytriphenyl phosphonium chloride plus 1.0 M sodium formate pH = 5.6 | 15,000 | 64 |

EXAMPLE VII

The beneficial effects on the current efficiency for ethylene glycol formation of various oxygenated derivatives was demonstrated using the cell and equipment described in Example VI. Here, the electrolyte solution consisted of 100 ml of formalin (ACS Eastman Kodak) containing 1.0 molar of sodium formate plus 1.0 g of the oxygenated derivative. The results of these experiments for passage of about 15,000 coulombs at a current density of about 70 mA/cm² and controlled potential of −2.1 V vs SCE are shown in TABLE 3.

TABLE 3

| Experiment | Oxygenated Derivative | Solution pH | Ethylene Glycol Current Efficiency (%) |
|---|---|---|---|
| 1 | chloranilic acid | 7.2 | 72 |
| 2 | 2,5-dihydroxy-p-benzoquinone | 7.8 | 82 |
| 3 | rhodizonic acid | 6.2 | 70 |
| 4 | ascorbic acid | 5.6 | 78 |
| 5 | phenidone | 5.5 | 65 |
| 6 | (squaric acid) (3,4-dihydroxy-3-cyclobutene-1,2-diene) | 5.7 | 70 |
| 7 | pyrogallic acid | 5.0 | 68 |

EXAMPLE VIII

To demonstrate the effectiveness of preoxidation on cathode performance, two Ultra Carbon ST-50 graphite rods were placed in an undivided electrochemical cell containing 100 ml of 10% aqueous sulfuric acid solution. Electrolysis was conducted at constant current (about 100 mA/cm$^2$) using a DC power supply and coulometer. About 10 cm$^2$ of the anode was immersed. After electrolysis at room temperature, with passage of 2000 coulombs, the electrolysis was stopped and the anode in this experiment was removed and washed well with water.

The above anode was next employed as a cathode for the electrochemical conversion of formaldehyde to ethylene glycol using the unseparated cell and equipment described in EXAMPLE VI. Electrolysis was conducted with a platinum anode using 1.0 M potassium acetate in 100 ml of formalin solution at 55° C., a pH of 7.5 and a controlled potential of −2.1 V vs SCE. After 11,850 coulombs, the current efficiency for ethylene glycol was found to be 86%. Under identical conditions with an Ultra Carbon ST-50 cathode, which had not been previously preoxidized, the current efficiency was 55%.

EXAMPLE IX

A useful anode process may be demonstrated by the following experiment. A plate-and-frame electrochemical cell is constructed of polypropylene. A cathode (10 cm$^2$) available from Union Carbide-ATJ graphite is set in one such frame. Electrical contact is made through the side of the frame. The anode (10 cm$^2$) is a Prototech PWB-3 gas diffusion electrode consisting of a high surface area carbon and a perfluorocarbon binder and having a platinum catalyst loading of 0.5 mg/cm$^2$. This anode is also set into a polypropylene frame, and electrical contact made on the non-solution side by means of a porous carbon plate. A polypropylene frame forms the electrolyte cavity between the anode and cathode and provides an inlet and outlet for solution flow. A further empty polypropylene frame forms a gas pocket of about 10 cm$^3$ on the non-solution side of the gas diffusion anode, which also includes a gas inlet and outlet. These various frames are gasketed with Viton® to prevent leakage of solution and anode gas feed. The entire assembly is clamped tightly together. The interelectrode gap is at about 0.5 cm. Electrolyte consisting of 250 ml of formalin (ACS Eastman Kodak) containing 1.0 M sodium formate, 0.5% by weight tetramethylammonium formate, and 0.5% by weight ascorbic acid having a pH of 6.5 and a temperature of 55° C. is recirculated through the cell by means of a pump at a flow rate of about 100 ml/min. At the same time hot methanol vapor (about 60° C.), carried on a stream of nitrogen gas and introduced into the polypropylene frame contacting the non-solution side of the anode, is oxidized to formaldehyde. Exiting gases are condensed and collected in a cold trap cooled by dry ice-acetone mixture. Electrolysis is conducted using a DC power supply at a cathode current density of 200 mA/cm$^2$. The ethylene glycol is formed at high current efficiencies.

EXAMPLE X

The apparatus of EXAMPLE X may also be used to demonstrate a further useful anode process, namely the in-situ oxidation of hydrogen gas to protons. Here, pure hydrogen is introduced into the polypropylene frame contacting the non-solution side of the anode. Exiting gases are not collected. Electrolysis is conducted using the same solution composition described in Example IX at a current density of 200 mA/cm$^2$ at 55° C. with passage of 25,000 coulombs. Ethylene glycol is formed at high current efficiencies.

While the invention has been described in conjunction with specific examples thereof, this is illustrative only. Accordingly, many alternatives, modifications and variations will be apparent to persons skilled in the art in light of the foregoing description, and it is therefore intended to embrace all such alternatives, modifications and variations as to fall within the spirit and broad scope of the appended claims.

What is claimed is:

1. In a method of making ethylene glycol by the electrochemical reduction of a formaldehyde-containing electrolyte, the improvement comprising maintaining the pH of the electrolyte from above about 5 to below about 7 to provide an ethylene glycol current efficiency of at least 50 percent.

2. The method of claim 1 wherein the pH of the electrolyte is from about 5.5 to about 6.5.

3. The method of claim 2 wherein the ethylene glycol current efficiency is at least 65 percent.

4. The method of claim 1 wherein the electrolyte comprises an aqueous solution having more than 10 percent by weight formaldehyde.

5. The method of claim 4 wherein the electrolyte comprises from about 30 to about 70 percent by weight formaldehyde.

6. The method of claim 5 wherein the electrolyte is an aqueous formalin solution.

7. The method of claim 6 wherein the formalin solution contains at least 37 percent by weight formaldehyde.

8. The method of claim 1 wherein the electrolyte includes a current efficiency enhancing amount of an oxygenated organic compound selected from hydroquinones, catechols, quinones, unsaturated α-hydroxy ketones and α-diketones.

9. The method of claim 1 wherein the electrolyte includes a current efficiency enhancing amount of a compound selected from the group consisting af alizarin, ascorbic acid, pyrogallic acid and 2,5-dihydroxy-p-benzoquinone.

10. The method of claim 1 wherein the reaction is conducted in a cell equipped with a graphite or carbon cathode having an oxidized surface.

11. The method of claim 1 wherein the reaction is conducted in a cell equipped with a gas diffusion anode.

12. In a method of making ethylene glycol by the electrochemical reduction of an aqueous formaldehyde-containing electrolyte, the improvement comprising conducting the reaction wherein the pH of the electrolyte is maintained at above about 5 to below about 7 and the elctrolyte is substantially free of methanol.

13. The method of claim 12 wherein the ethylene glycol current efficiency is at least 65 percent.

14. The method of claim 13 wherein the formaldehyde-containing electrolyte includes a sufficient amount of an oxygenated organic compound to increase the current efficiency.

15. The method of claim 14 wherein the reaction is conducted in an electrolytic cell equipped with a porous separator or ion-exchange membrane.

16. The method of claim 15 wherein the cell is equipped with a preoxidized graphite cathode.

17. In a method of making ethylene glycol by the electrochemical reduction of a formaldehyde-containing electrolyte, the improvement comprising conducting the reaction in the presence of a sufficient amount of a quaternary salt to provide an ethylene glycol current efficiency of at least 50 percent.

18. The method of claim 17 wherein the electrolyte includes a sufficient amount of a quanternary salt selected from ammonium, phosphonium and sulfonium salts to provide an ethylene glycol current efficiency of at least 65 percent.

19. The method of claim 18 wherein the electrolyte comprises a quaternary ammonium salt.

20. the method of claim 18 wherein the pH of the electrolyte is from about 3.0 to about 8.0.

21. In a method for the electrosynthesis of ethylene glycol by the reduction of a formaldehdye-containing electrolyte in an electrolytic cell equipped with anodes and cathodes, the improvement comprising conducting the electrosynthesis with graphite or carbon cathodes having a preoxidized surface.

22. The method of claim 21 wherein the reaction is conducted with a gas diffusion anode and/or gas diffusion cathode.

23. The method of claim 22 wherein the cathode is a porous, high surface area cathode having from about 20 to about 80 percent porosity.

24. A method for the electrosynthesis of ethylene glycol from the reduction of a formaldehyde-containing electrolyte, which comprises the steps of providing an electrolytic cell equipped with an anode, a graphite or carbon cathode and a separator or membrane positioned between the anode and cathode, and conducting a useful process at the anode simultaneously with the electrosynthesis of ethylene glycol at the cathode.

25. The method of claim 24 wherein the useful process comprises forming at least a portion of the formaldehyde-containing electrolyte by oxidation of methanol at the anode.

26. The method of claim 24 wherein the useful process comprises the formation of protons by oxidation of hydrogen at the anode.

27. The method of claim 24 wherein the cell is equipped with a gas diffusion electrode.

28. The method of claim 27 wherein the gas diffusion electrode is a cathode receiving a gaseous feed of anhydrous or wet formaldehyde.

29. In a method for electrosynthesis of ethylene glycol by the reduction of a formaldehyde-containing electrolyte, the improvement comprising the step of incorporating into the electrolyte a current efficiency enhancing amount of a glycol catalyzing oxygenated organic compound.

30. The method of claim 29 wherein the oxygenated organic compounds are selected from hydroquinones, catechols, quinones, unsaturated $\alpha$-hydroxy ketones and $\alpha$-diketones.

31. The method of claim 29 wherein the oxygenated organic compounds are selected from alizarin, ascorbic acid, pyrogallic acid and 2,5-dihydroxy-p-benzoquinone.

32. A method for the electrosynthesis of ethylene glycol which comprises conducting the electrosynthesis reaction in an electrolytic cell equipped with an anode and a graphite or carbon cathode wherein said cathode is a gas diffusion type and receives a gaseous feed of anhydrous or wet formaldehyde.

33. The method of claim 32 wherein the cell is equipped with a porous separator or ion exchange membrane.

34. The method of claim 27 wherein the gas diffusion electrode is an anode receiving a gaseous mixture of hydrogen and carbon monoxide.

35. A method for the electrosynthesis of ethylene glycol by the reduction of a formaldehyde-containing electrolyte, which comprises providing an electrolytic cell equipped with a gas diffusion anode and a graphite or carbon cathode, said method including the step of generating at least a portion of the formaldehyde-containing electrolyte by oxidation of methanol at said gas diffusion anode.

* * * * *